US011253062B1

(12) United States Patent
Hostler et al.

(10) Patent No.: US 11,253,062 B1
(45) Date of Patent: Feb. 22, 2022

(54) ADJUSTABLE STORAGE RACK FOR A FIRST RESPONDER

(71) Applicant: Groves, Inc., Woodstock, IL (US)

(72) Inventors: Brent James Hostler, Lake In The Hills, IL (US); John Staley Groves, Bokeelia, FL (US)

( * ) Notice: Subject to any disclaimer, the term of this patent is extended or adjusted under 35 U.S.C. 154(b) by 89 days.

(21) Appl. No.: 16/272,582

(22) Filed: Feb. 11, 2019

(51) Int. Cl.

| | |
|---|---|
| ***A47B 43/00*** | (2006.01) |
| ***A47B 55/02*** | (2006.01) |
| ***A47B 57/58*** | (2006.01) |
| ***A47B 47/02*** | (2006.01) |
| *A47B 81/00* | (2006.01) |
| *A47B 47/00* | (2006.01) |

(52) U.S. Cl.
CPC ..... *A47B 57/585* (2013.01); *A47B 47/027* (2013.01); *A47B 47/0075* (2013.01); *A47B 81/00* (2013.01); *A47B 2220/0002* (2013.01)

(58) Field of Classification Search
CPC . A47B 57/585; A47B 47/027; A47B 47/0075; A47B 81/00; A47B 2220/0002
See application file for complete search history.

(56) References Cited

U.S. PATENT DOCUMENTS 3,007,708 A 11/1961 Ochs
3,533,502 A * 10/1970 Hansen ..... A47B 45/00 206/386
D288,641 S 3/1987 Kester
5,308,037 A * 5/1994 Gonzalez ..... F24F 13/32 248/670
6,241,107 B1 * 6/2001 Boyer ..... A47F 5/137 211/181.1
D471,381 S 3/2003 Yamaguchi
6,659,294 B1 12/2003 Simard
6,966,574 B1 * 11/2005 Dahl ..... B62B 1/002 280/47.18
D660,457 S * 5/2012 Lombard ..... D25/62
8,827,232 B2 * 9/2014 Crowley ..... A47B 43/003 248/670
9,010,553 B2 * 4/2015 Crowley ..... A47B 43/003 211/189
9,228,756 B2 * 1/2016 Crowley ..... A47B 43/003
9,493,295 B2 * 11/2016 Glover ..... B65D 85/48
9,629,455 B2 * 4/2017 Shah ..... A47F 5/0892
9,737,141 B2 8/2017 Johnson
2003/0160014 A1 * 8/2003 Cuzzocrea ..... A47F 5/083 211/113

(Continued)

FOREIGN PATENT DOCUMENTS

GB 2512029 A * 9/2014 ..... A47B 96/04

*Primary Examiner* — Kimberley S Wright

(57) ABSTRACT

This invention maximizes storage capacity for emergency first responder equipment for various spaces by providing an adjustable storage rack for a first responder, which has adjustable sides or an adjustable base. The adjustable storage rack for a first responder is suitable for use in storing gear for firemen or other first responders for quick access. The modular nature of this invention is a necessary element of maximizing the storage capacity of various spaces. This adjustable storage rack for a first responder solves these issues by providing the most amount of storage capacity in a given space and allows emergency first responders more efficient access to clothing or equipment, in order to become fully equipped and expeditiously deployed.

9 Claims, 6 Drawing Sheets

(56) References Cited

U.S. PATENT DOCUMENTS

| | | | | |
|---|---|---|---|---|
| 2005/0055950 | A1* | 3/2005 | Dantzler, III | A47F 5/137<br>52/633 |
| 2008/0006595 | A1* | 1/2008 | Black | A47B 47/025<br>211/181.1 |
| 2011/0074256 | A1 | 3/2011 | Boice | |
| 2012/0181240 | A1* | 7/2012 | Crowley | A47B 43/003<br>211/26 |
| 2013/0228536 | A1* | 9/2013 | Crowley | A47B 43/003<br>211/26 |

* cited by examiner

ADJUSTABLE STORAGE RACK FOR A FIRST RESPONDER

This invention relates to an adjustable storage rack for a first responder and, more particularly to an adjustable storage rack for a first responder rack suitable for use in storing gear for firemen or other first responders for quick access.

BACKGROUND OF THE INVENTION

Speed and efficiency are important for first responders, such as firemen or other personnel. People in those professions are usually the first people on the scene of accident to respond to that emergency situation. Such people are usually mobilized from patrolling a certain area or a fixed site. A storage rack is an important part of a fixed site, so that personnel can gather the proper equipment quickly and respond to an emergency.

To that end, various storage supports are required to keep equipment ready for use. Such a storage rack must support the clothing or equipment in an accessible and usable position, so that a person responding to an emergency may quickly obtain the desired clothing and equipment, when necessary, and leave for the scene of the accident, fire or other incident.

This readiness is especially critical for personnel responding to a fire. Each of these people must use a heavy load of protective gear. The weight of that gear makes proper storage thereof critical, but difficult to achieve. The storage rack must effectively store heavy coats, pants and boots as well as other equipment; while at the same time leaving material in the storage rack easily accessible for a quick use.

Additionally at a firehouse, floor space must be used efficiently. A storage rack must make efficient use of the space it occupies. If the storage rack is not full, it occupies more space than needed. With the recovery of that space, better efficiency at the firehouse can be achieved.

To that end, the storage rack must be able to support the weight of the gear placed therein, as well as have flexibility to permit effective use of the storage space. This is especially true in a firehouse. Positioning and readjusting of the storage rack must be accomplished with minimal effort, while at the same time leaving the clothing and other equipment ready for use quickly.

Therefore, it becomes clear that a storage rack must have adequate storage space for appropriate equipment, while at the same time not use too much floor space. A mechanism or storage rack to achieve these goals offers great advantages.

SUMMARY OF THE INVENTION

Among the many objectives of the present invention is the provision of an adjustable storage rack for a first responder that is adjustable and easily moved.

Another objective of the present invention is the provision of an adjustable storage rack for a first responder mounted on wheels.

Yet another objective of the present invention is the provision of an adjustable storage rack for a first responder, which is expandable.

Still another objective of the present invention is the provision of an adjustable storage rack for a first responder, which is adjustable.

These and other objectives of the invention (which other objectives become clear by consideration of the specification, claims and drawings as a whole) are met by providing an adjustable storage rack for a first responder which has adjustable sides or an adjustable base.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
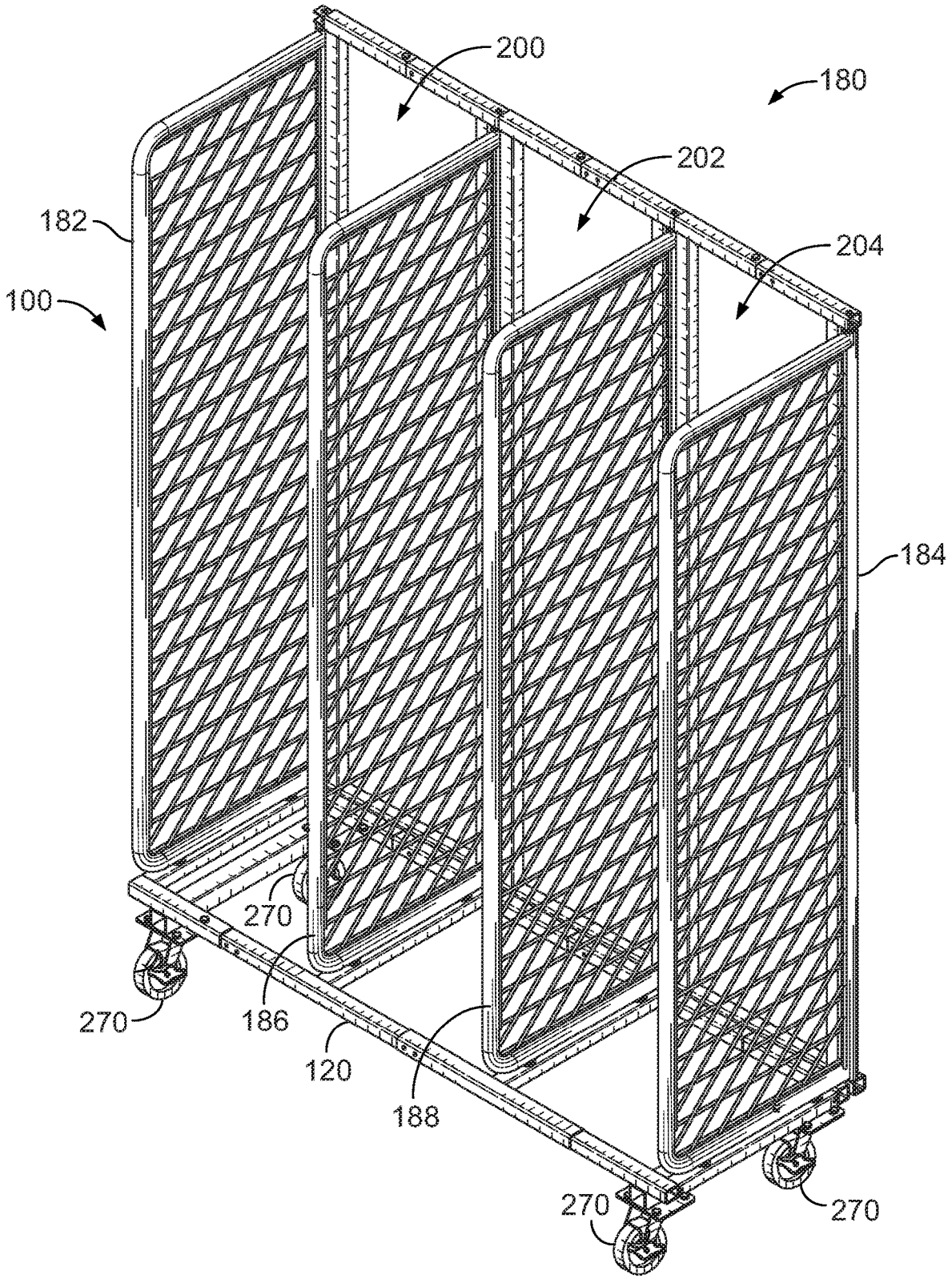
FIG. 1 depicts a front perspective view of an adjustable storage rack for a first responder 100 of this invention.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

This invention relates to an adjustable storage rack for a first responder suitable for use in storing gear for firemen or other first responders for quick access. The modular nature of this invention is a necessary element of maximizing the storage capacity of various spaces.

This invention solves these issues by providing the most amount of storage capacity in a given space and allows emergency first responders more efficient access to clothing or equipment, in order to become fully equipped and expeditiously deployed.

Figure 2:
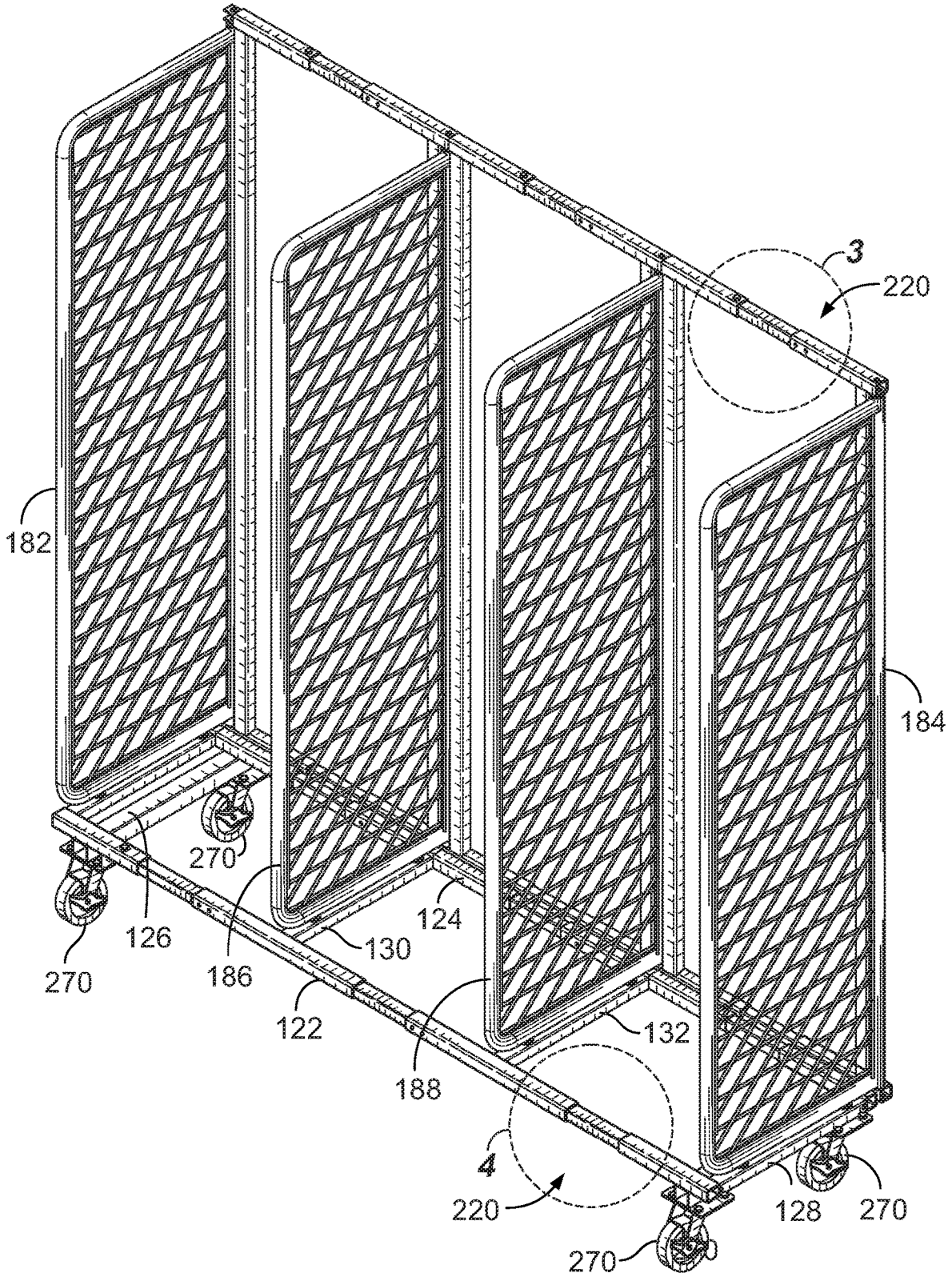
FIG. 2 depicts a front perspective view of an adjustable storage rack for a first responder 100 of this invention as expanded.

Referring now to FIG. 1 and FIG. 2, an adjustable storage rack for a first responder 100 of this invention has a base support 120 with a back support 150 mounted thereon. Preferably the back support 150 is mounted substantially perpendicular to the base support 120. Connected to both the base support 120 and the back support 150 is a divider assembly 180. The adjustable storage rack for a first responder 100 may be supported on wheels 270 secured thereto.

Divider assembly 180 includes a first end divider 182 and a second end divider 184. The first end divider 182 and the second end divider 184 are positioned at opposing ends of the base support 120 and the back support 150.

Between the first end divider 182 and the second end divider 184 are a first interior divider 186 and a second interior divider 188. The first end divider 182, the second end divider 184, the first interior divider 186 and the second interior divider 188 cooperate to form a first section 200, a second section 202 and a third section 204. Within each section can be stored equipment for a person.

The base support 120 has a front adjustable rail 122 and a rear adjustable rail 124. Back support 150 is preferably connected to rear adjustable rail 124. Connected to each end thereof, that is front adjustable rail 122 and rear adjustable rail 124, is a first support bar 126 and a second support bar 128—thus forming base support 120 into a rectangle. The first end divider 182 is mounted over the first support bar support 126. The second end divider 184 is mounted over the second support bar 128.

Between first support bar 126 and second support bar 128 are first interior bar 130 and second interior bar 132. First support bar 126, second support bar 128, first interior bar 130 and second interior bar 132 connect front adjustable rail 122 to rear adjustable rail 124. The first interior bar 130 and second interior bar 132 support the first interior divider 186 and the second interior divider 188 respectively. The first interior divider 186 and the second interior divider 188 form the sections 200, 202 and 204 respectively. Wheels 270 permit an adjustable storage rack for a first responder 100 to be moved more easily.

Figure 3:
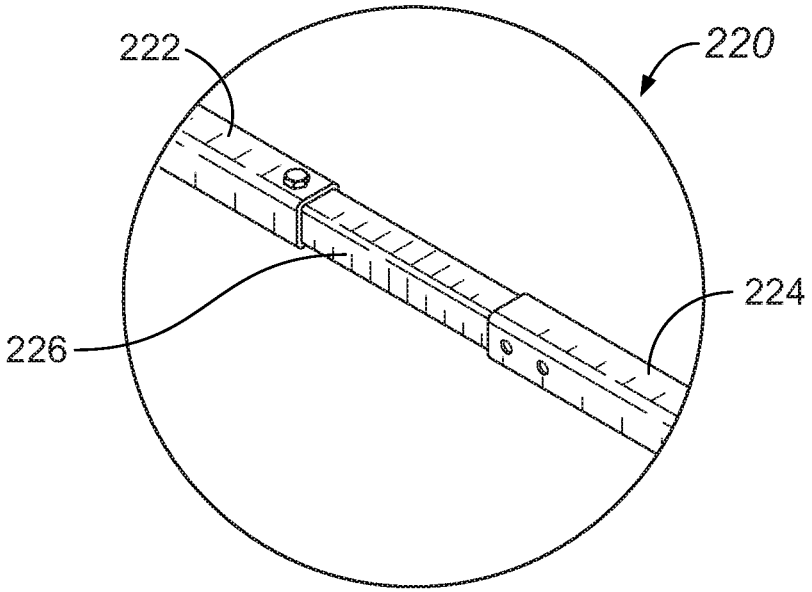
FIG. 3 depicts a perspective view of a upper expansion joint 220 for an adjustable storage rack for a first responder 100 of this invention.

Adding FIG. 3 to the consideration with FIG. 2, upper expansion joint 220 has a first female section 222 and a second female section 224. Upper joining bar 226 has its opposing ends in the form of first upper male end 228 and second upper male end 230. First upper male end 228 fits into the first female section 222, while the second upper male end 230 fits into the second female section 224. By securing the first upper male end 228 and the second upper male end 230 into the expansion joint 220, the size of adjustable storage rack for a first responder 100 can be adjusted as required when used in combination with similar structures.

Figure 4:
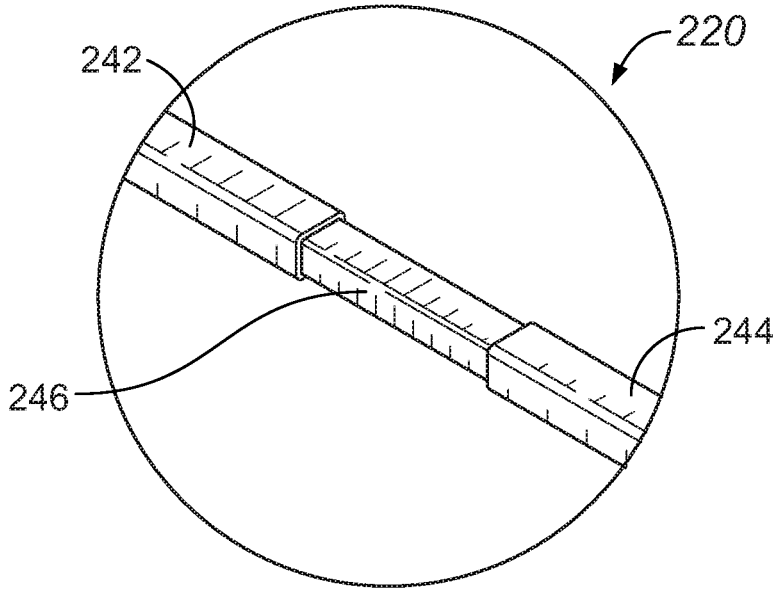
FIG. 4 depicts a perspective view of a bottom expansion joint 240 for an adjustable storage rack for a first responder 100 of this invention.

Adding FIG. 4 to the consideration with FIG. 2, various channel members have expansion joints. A lower expansion joint 240 has a first lower female section 242 and a second lower female section 244. Lower joining bar 246 has its opposing ends in the form of first lower male end 248 and second lower male end 250. First lower male end 248 fits into the first lower female section 242, while the second lower male end 250 fits into the second lower female section 244. By securing the first lower male end 248 and the second lower male end 250 into the lower expansion joint 240, the size of adjustable storage rack for a first responder 100 can be adjusted as required when used in combination with similar structures.

Figure 5:
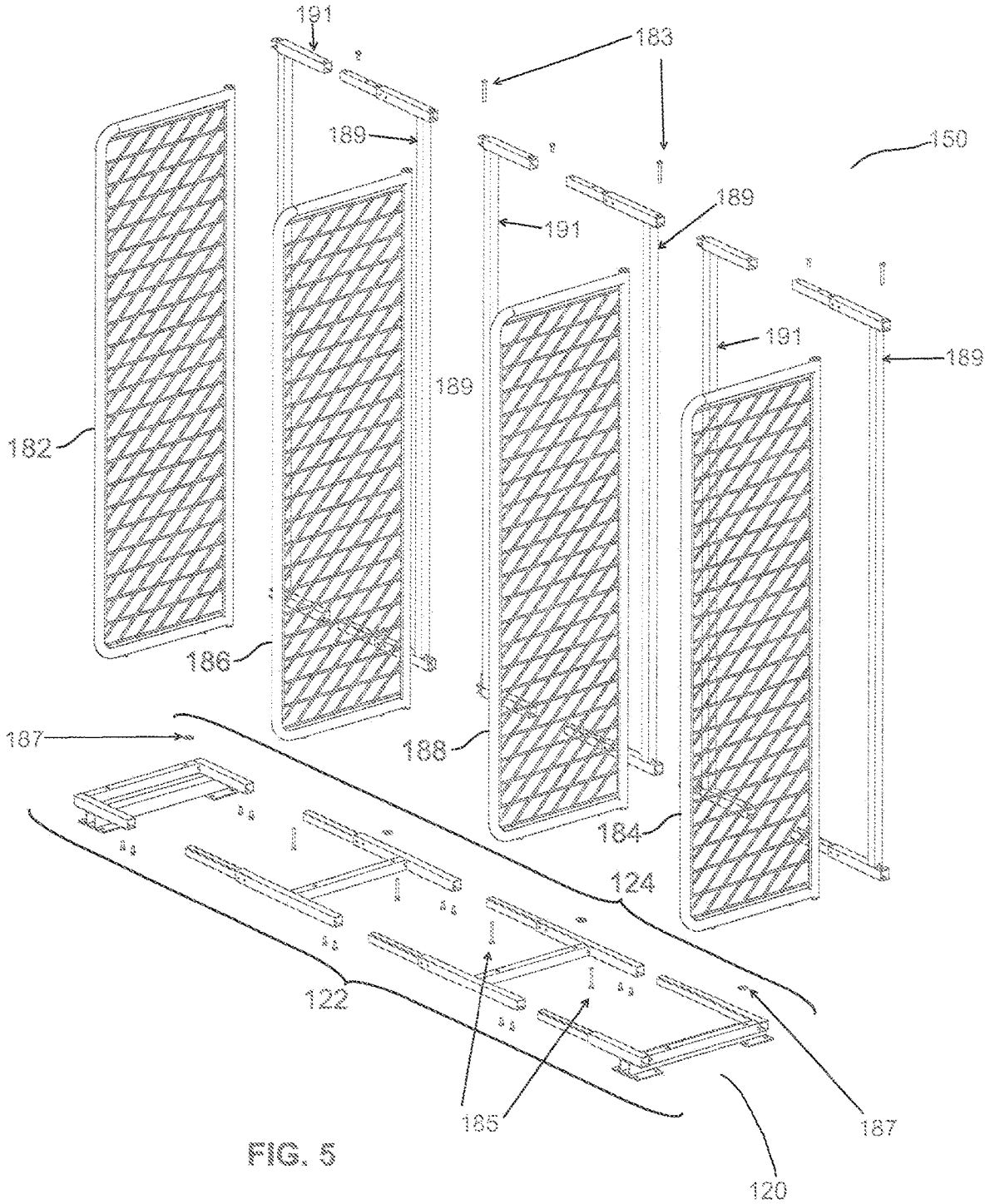
FIG. 5 depicts an exploded, perspective view for an adjustable storage rack for a first responder 100 of this invention.
Figure 6:
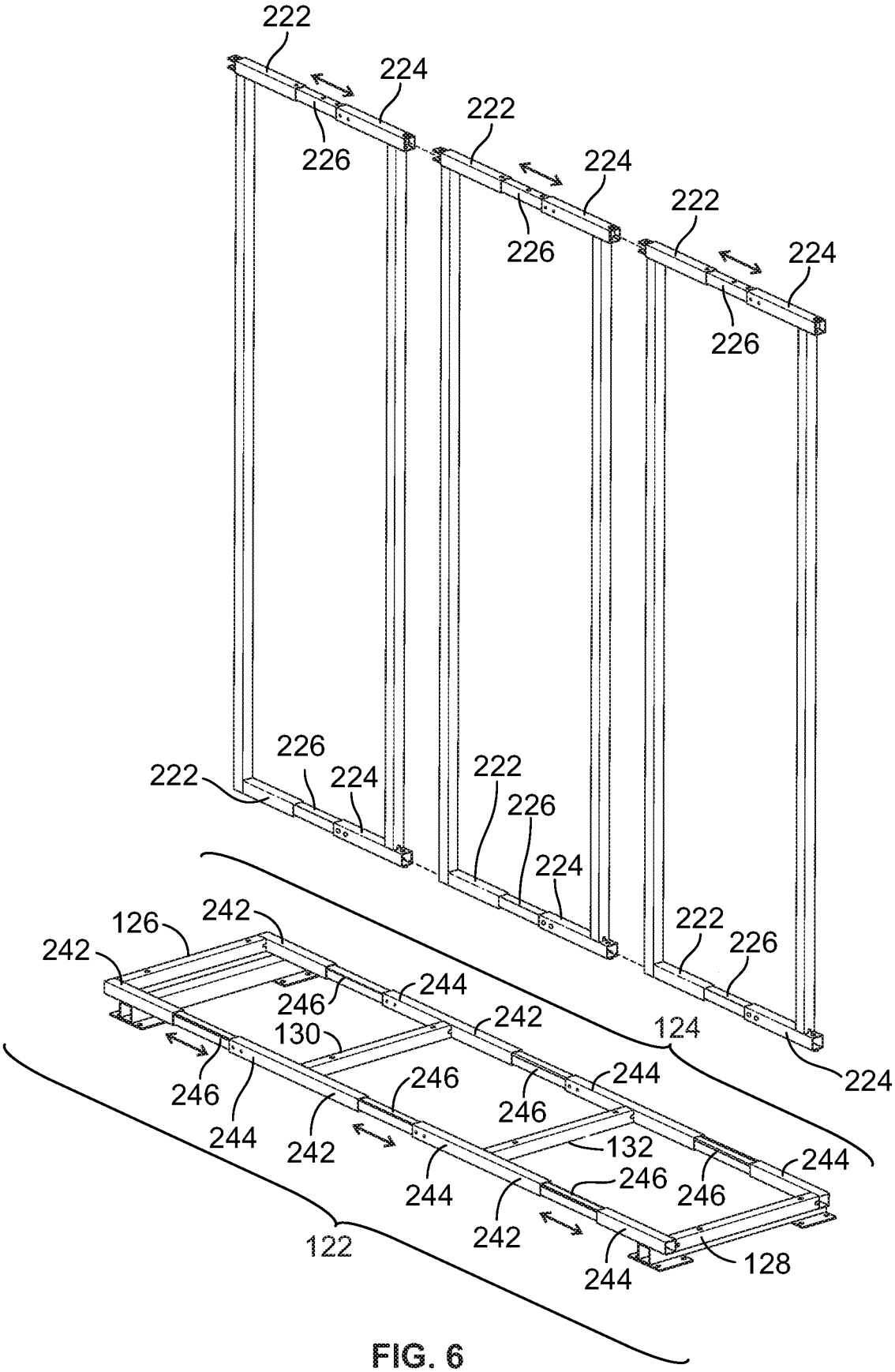
FIG. 6 depicts a partially exploded, perspective view of an upper expansion joint 220 and a bottom expansion joint 240 for an adjustable storage rack for a first responder 100 of this invention.
Figure 7:
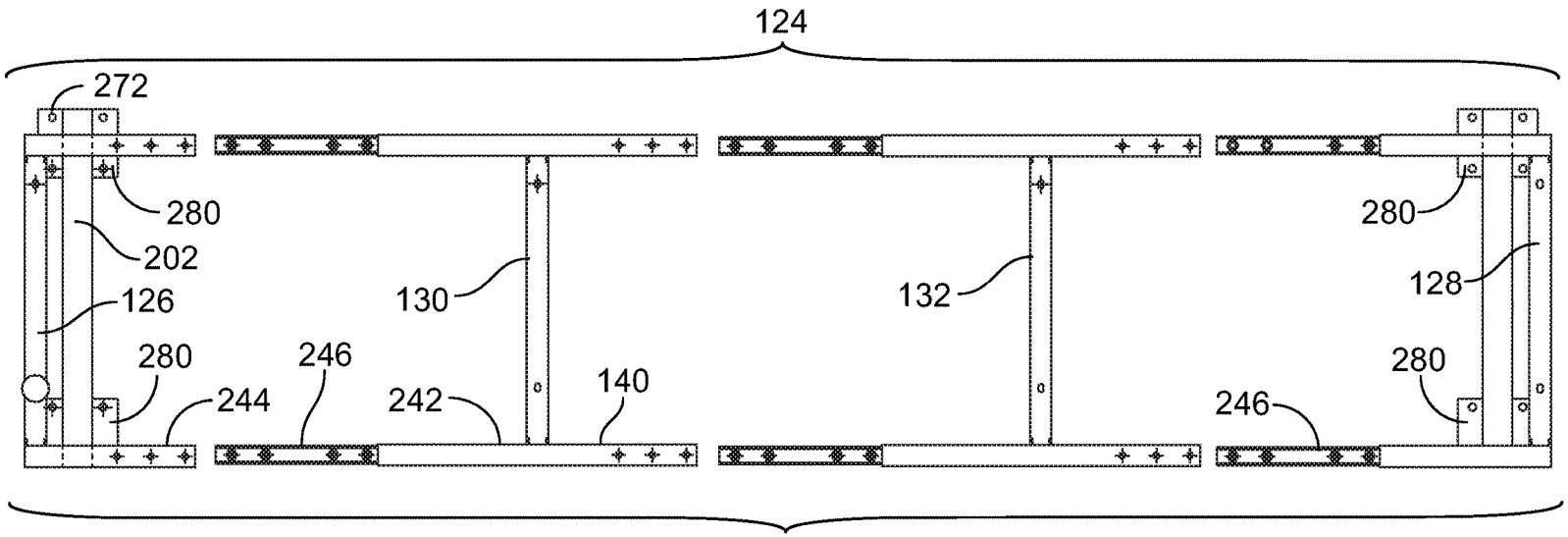
FIG. 7 depicts a partially exploded, top plan view of a base support 120 for an adjustable storage rack for a first responder 100 of this invention.
Figure 8:
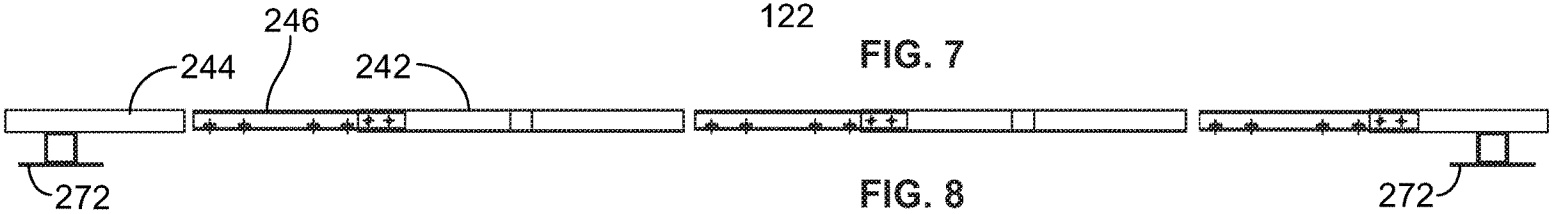
FIG. 8 depicts a partially exploded, side view of a base support 120 for an adjustable storage rack for a first responder 100 of this invention, based on FIG. 7.

Considering FIG. 5, the upper divider bolt 183, and lower divider bolt 185 secure the dividers 182, 184, 186, and 188 between the right back support rail 189 and the left back support rail 191 of the back support 150 and res of the base support 120. A cushion 187 may be used to keep the dividers 182, 184, 186, and 188 from scraping/rattling on the base support 120.

The further addition of FIG. 5, FIG. 6, FIG. 7 and FIG. 8 shows how a plurality of lower expansion joints 240 and other expansion joints 220 assemble the adjustable storage rack for a first responder 100 according to FIG. 3 and FIG. 4. Between first support bar 126 and second support bar 128 are first interior bar 130 and second interior bar 132. First support bar 126, second support bar 128, first interior bar 130 and second interior bar 132 connect front adjustable rail 122 to rear adjustable rail 124. The first interior bar 130 and second interior bar 132 support the first interior divider 186 and the second interior divider 188 respectively.

Considering now FIG. 6, FIG. 7, FIG. 8, FIG. 9, FIG. 10 and FIG. 11, the expandability of the adjustable storage rack for a first responder 100 becomes clearer. A wheel 270 (FIG. 1) is secured to each of the four wheel platforms 280 to make the adjustable storage rack for a first responder 100, FIG. 9 and FIG. 10 cooperate with FIG. 3 and FIG. 4 to show how upper joining bar 226 and lower joining bar 246 assemble the adjustable storage rack for a first responder 100. Clamping bar 260 of FIG. 11 holds joining bar 226 or 246 in place as desired with nuts 262, which are received or released in cooperation with closing bar 264.

Figure 11:
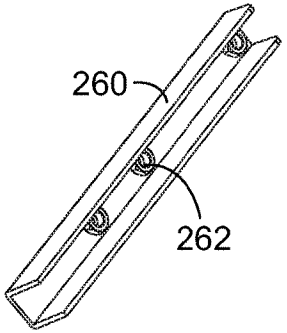
FIG. 11 depicts a perspective view of a locking sleeve 140 for use with a first interior bar 130 and a base support 120 for an adjustable storage rack for a first responder 100 of this invention.
Figure 10:
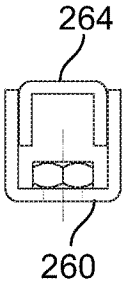
FIG. 10 depicts an end view of an assembly using first interior bar 130 for use with base support 120 for an adjustable storage rack for a first responder 100 of this invention, based on FIG. 9.
Figure 9:
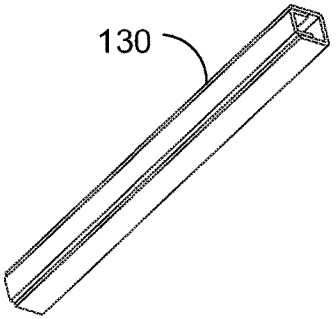
FIG. 9 depicts a perspective view of a first interior bar 130 for use with base support 120 for an adjustable storage rack for a first responder 100 of this invention.

FIG. 9, FIG. 10, and FIG. 11 depict first interior bar 130 for use with base support 120. First interior bar 130 (FIG. 9) has clamping bar 260 (FIG. 11) receiving closing bar 264. The clamping bar 260 has the at least two nuts 262 (FIG. 11) positioned therein, while FIG. 10 shows clamping bar 260 and closing bar 264 go together when the support base 120 is assembled.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. An adjustable storage rack for a first responder comprising:

at least two clamping bars permit adjustability for the adjustable storage rack for a first responder;

the adjustable storage rack for a first responder has a base support, a back support, and a divider assembly;

the base support has a front support edge and a rear support edge;

the base support is substantially parallel to a floor;

the base support is mounted on the rear support edge;

the base support has a front adjustable rail and a rear adjustable rail;

a first support bar is connected to a first end of the front adjustable rail and the second adjustable rail;

the front adjustable rail and the second adjustable rail are connected to opposing ends of the first support bar;

a second support bar is connected to a second end of the front adjustable rail and the second adjustable rail;

the front adjustable rail and the second adjustable rail are connected to opposing ends of the second support bar;

the divider assembly includes a first end divider, a second end divider a first interior divider and a second interior divider;

the first end divider and the second end divider are positioned at opposing ends of the base support and the back support;

the first interior divider and the second interior divider are positioned between the first end divider and the second end divider;

the back support is substantially perpendicular to the rear support edge;

the first end divider is mounted over or on the first support bar;

the second end divider is mounted over or on the second support bar;

the first interior bar and second interior bar are mounted between the first support bar and the second support bar; and the first support bar, the second support bar, the first interior bar and the second interior bar connect the front adjustable rail to rear adjustable rail;

the back support is mounted on the base support through a connection between the divider assembly;

the divider assembly forms the base support and the back support into at least one section; and the first end divider, the second end divider, the first interior divider, and the second interior divider cooperate with the base support and the back support to form at least one section; and the at least one section, is capable of receiving or storing clothing and equipment;

the first end divider and the second end divider are secured to opposing ends of the base support and the back support;

a first interior divider and a second interior divider are positioned between the first end divider and the second end divider;

the first interior divider and the second interior divider are secured to opposing ends of the base support and the back support;

the first interior bar supports the first interior divider;

the second interior bar supports the second interior divider;

the first end divider, the first interior divider, the second interior divider and the second end divider are positioned on the base support and relative to the back support in that order; and the connection between the divider assembly includes an upper divider bolt that connects the divider assembly to the back support, and at least one lower divider bolt that connects the divider assembly to the base support.

2. The adjustable storage rack for a first responder of claim 1 further comprising:

the base support is substantially rectangle in shape;

the base support having a wheel mount at or adjacent to each of four corners of the rectangle;

each wheel receiving a wheel to facilitate movement of the adjustable storage rack for a first responder;

the back support having at least one upper expansion joint;

the at least one upper expansion joint has a first female section and a second female section;

an upper joining bar has at its opposing ends a first upper male end and a second upper male end;

the first upper male end fits into the first female section; and the second upper male end fits into the second female section.

3. The adjustable storage rack for a first responder of claim 2 further comprising:

the first upper male end is releasably secured into the first female section;

the second upper male end is releasably secured into the second female section;

the base support has at least one lower expansion joint;

the at least one lower expansion joint has a first lower female section and a second lower female section;

a lower joining bar connects the first lower female section and the second lower female section;

the lower joining bar has opposing ends in the form of a first lower male end and a second lower male end; the first lower male end fits into the first lower female section; and the second lower male end fits into the second lower female section.

4. The adjustable storage rack for a first responder of claim 3 further comprising:

the base support has a front adjustable rail and a rear adjustable rail;

the back support is connected to the rear adjustable rail;

a first support bar connects the front adjustable rail and the rear adjustable rail at a first end thereof;

a second support bar connects the front adjustable rail and the rear adjustable rail at a second end thereof; the first end divider is mounted over the first support bar;

the second end divider mounted over the second support bar;

a first interior bar and a second interior bar are connected at opposing ends thereof to the front adjustable rail and the rear adjustable rail;

the at least one lower expansion joint and the at least one upper expansion joint are releasably positioned by at least push button lock;

the first interior bar supports the first interior divider; and the second interior bar supports the second interior divider.

5. In a storage rack, the improvement comprising:

the storage rack is an adjustable storage rack;

the storage rack being an adjustable storage for a first responder;

at least two clamping bars permit adjustability for the adjustable storage rack;

the adjustable storage rack has a base support, a back support, and a divider assembly;

the base support has a front support edge and a rear support edge;

the base support is substantially parallel to a floor;

the base support is mounted on the rear support edge;

the base support has a front adjustable rail and the rear adjustable rail;

the back support is substantially perpendicular to the rear support edge;

the divider assembly includes a first end divider, a second end divider, a first interior divider and a second interior divider;

the first end divider and the second end divider are positioned at and secured to opposing ends of the base support and the back support;

the first interior divider and the second interior divider are positioned between the first end divider and the second end divider;

the first end divider, the second end divider, the first interior divider, and the second interior divider cooperate with the base support and the back support to form at least one section; and the second end divider the second interior divider fond the third section; and the first interior divider and the second interior divider are secured to opposing ends of the base support and the back support;

the first end divider is mounted over or on the first support bar;

the second end divider is mounted over or on the second support bar;

the first interior bar supports the first interior divider;

the second interior bar supports the second interior divider;

the first end divider, the first interior divider, the second interior divider and the second end divider are positioned on the base support and relative to the back support in that order;

the divider assembly interacts with the base support and the hack support to form at least one section that is capable of receiving or storing clothing and equipment; and the back support is comprised of at least one right hack support rail and at least one left back support rail;

a first support bar is connected to a first end of the front adjustable rail and the second adjustable rail;

the front adjustable rail and the second adjustable rail are connected to opposing ends of the first support bar;

a second support bar is connected to a second end of the front adjustable rail and the second adjustable rail; the front adjustable rail and the second adjustable rail are connected to opposing ends of the second support bar;

the first interior bar and second interior bar are mounted between the first support bar and the second support bar; and the first support bar, the second support bar, the first interior bar and the second interior bar connect the front adjustable rail to rear adjustable rail;

the back support is oriented with a space between the at least one right back support rail and the at least one left back support rail to receive the divider assembly;

the back support is mounted on the base support through a connection between the divider and assembly; and the connection between the divider assembly includes an upper divider bolt that connects the divider assembly to the back support and at least one lower divider bolt that connects the divider assembly to the base support.

6. The storage rack of claim 5 further comprising:

the base support being substantially rectangle in shape;

the base support having a wheel mount at or adjacent to each of four corners of the rectangle;

each wheel receiving a wheel to facilitate movement of the adjustable storage rack for a first responder;

the back support having at least one upper expansion joint;

the at least one upper expansion joint having a first female section and a second female section;

an upper joining bar having at its opposing ends a first upper male end and a second upper male end;

the first upper male end fitting into the first female section; and the second upper male end fits into the second female section.

7. The storage rack of claim 6 further comprising:

the first upper male end is releasably secured into the first female section;

the second upper male end is releasably secured into the second female section;

the base support has at least one lower expansion joint;

the at least one lower expansion joint has a first lower female section and a second lower female section;

a lower joining bar connects the first lower female section and the second lower female section;

the lower joining bar has opposing ends in the form of a first lower male end and a second lower male end;

the first lower male end fits into the first lower female section; and the second lower male end fits into the second lower female section.

8. The storage rack of claim 7 further comprising:

the base support has a front adjustable rail and a rear adjustable rail;

the back support is connected to the rear adjustable rail;

a first support bar connects the front adjustable rail and the rear adjustable rail at a first end thereof;

a second support bar connects the front adjustable rail and the rear adjustable rail at a second end thereof;

the first end divider is mounted over the first support bar;

the second end divider mounted over the second support bar;

a first interior bar and a second interior bar are connected at opposing ends thereof to the front adjustable rail and the rear adjustable rail;

the at least one lower expansion joint and the at least one upper expansion joint are releasably positioned by at least push button lock;

the first interior bar supports the first interior divider; and the second interior bar supports the second interior divider.

9. A method for providing an adjustable storage rack for a first responder comprising:

having the back support include at least one right back support rail and at least one left back support rail;

mounting the back support on the base support;

providing the divider assembly with a series of dividers, including a first end divider, a second end divider, a first interior divider and a second interior divider;

having the divider assembly form the base support and the back support into at least two sections by standing a divider of the series of dividers between the at least one right back support rail and at least one left back support rail and on top of the base support and connecting the dividers with at least one upper divider bolt and at least one lower divider bolt;

positioning the first end divider and the second end divider at opposing ends of the base support and the back support;

positioning the first interior divider and the second interior divider between the first end divider and the second end divider; and providing the base support with a front support edge and a rear support edge;

having the first end divider, the second end divider; the first interior divider, and the second interior divider cooperate with the base support and the back support to form at least one section;

mounting the back support substantially perpendicular to the base support on the rear support edge;

securing the first end divider and the second end divider to opposing ends of the base support and the back support;

positioning a first interior divider and a second interior divider between the first end divider and the second end divider;

having the first end divider, the second end divider, the first interior divider, and the second interior divider cooperate with the base support and the back support to form at least one section;

having the front adjustable rail and the second adjustable rail connected to opposing ends of the first support bar;

having a second support bar connected to a second end of the front adjustable rail and the second adjustable rail;

having the front adjustable rail and the second adjustable rail connected to opposing ends of the second support bar;

having the first end divider mounted over or on the first support bar;

having the second end divider mounted over or on the second support bar; and having the first interior bar and second interior bar mounted between the first support bar and the second support bar;

having the first support bar, the second support bar, the first interior bar and the second interior bar connect the front adjustable rail to rear adjustable rail;

supporting the first interior divider with the first interior bar;

supporting the second interior divider with the second interior bar;

positioning the first end divider, the first interior divider, the second interior divider and the second end divider on the base support and relative to the back support in that order;

having the at least two sections become three sections;

providing the back support having at least one upper expansion joint;

providing the base support with at least one lower expansion joint;

the base support has providing a front adjustable rail and a rear adjustable rail;

the back support is connected to the rear adjustable rail;

a first support bar connects the front adjustable rail and the rear adjustable rail at a first end thereof;

a second support bar connects the front adjustable rail and the rear adjustable rail at a second end thereof;

the first end divider is mounted over the first support bar;

the second end divider mounted over the second support bar;

a first interior bar and a second interior bar are connected at opposing ends thereof to the front adjustable rail and the rear adjustable rail;

the at least one lower expansion joint and the at least one upper expansion joint are releasably positioned by at least push button lock;

the first interior bar supports the first interior divider; and the second interior bar supports the second interior divider.

* * * * *